United States Patent [19]

Erickson

[11] 4,434,717

[45] Mar. 6, 1984

[54] HYBRID FUSE TRIGGERING DEVICE

[75] Inventor: Lawrence F. Erickson, San Jose, Calif.

[73] Assignee: The United States of America as represented by the Secretary of the Navy, Washington, D.C.

[21] Appl. No.: 295,175

[22] Filed: Aug. 21, 1981

[51] Int. Cl.[3] ..... F42C 11/02

[52] U.S. Cl. ..... 102/210; 102/200; 102/206; 102/220

[58] Field of Search ..... 102/210, 206, 200, 220

[56] References Cited

U.S. PATENT DOCUMENTS

| | | | |
|---|---|---|---|
| 3,031,968 | 5/1962 | Dowdell | 102/210 |
| 3,196,794 | 7/1965 | Meade | 102/210 |
| 3,225,695 | 12/1965 | Kapp et al. | 102/220 |
| 3,359,904 | 12/1967 | Nerheim | 102/210 |
| 3,598,055 | 8/1981 | Gunderson | 102/220 |
| 3,967,555 | 7/1976 | Gawlick | 102/210 |

*Primary Examiner*—Charles T. Jordan

*Attorney, Agent, or Firm*—R. F. Beers; W. Thom Skeer

[57] ABSTRACT

A fuse triggering device for air to air missiles incorporates a readily removable housing consisting of a threaded member mounted on a standard nut as a base and a hermetically sealed cover. The electronic components are wafered on a silicon substrate disc using a field effect transistor circuit to interrupt a transducer generated pulse as a gate for a silicon controlled rectifier which passes a triggering pulse.

12 Claims, 2 Drawing Figures

HYBRID FUSE TRIGGERING DEVICE

BACKGROUND OF THE INVENTION

1. Field of the Invention:

This invention relates to piezo-electric fuzes such as are used to fire the charge of a projectile. More particularly this invention relates to a fuze-triggering device, having a piezo-electric crystal as its detonation signal generator.

A particular application of this invention is in advanced air-to-air missiles.

2. Description of the Prior Art:

It is conventional to use, in a percussion fuze, a piezo-electric element which converts a portion of the mechanical impact energy produced upon impingement on the target into an electric voltage. This voltage is transferred by way of a semiconductor component, with trigger or threshold characteristics, to the detonator in order to ignite the latter.

The fuze triggering device, (FTD) which the present invention was designed to replace is used in air-to-air missiles. The prior FTD used some components that previously were readily available industry wide, but which now require a long lead time in procurement and have limited sources of supply. In particular the uni junction transistor used in the triggering circuitry has only a single known source of supply.

Previous fuze triggering devices were easily damaged when removed from the fuze well. Testing, to look for a damaged component, etc., was virtually impossible due to the FTD construction. Additionally the prior FTD used a damping compound to surround all the electrical parts and this compound has caused failure of the parts when it underwent a change in temperatures.

SUMMARY OF THE INVENTION

The present invention embodies a new packaging design having an improved mounting base which incorporates a threaded screw. A dual housing arrangement having an apertured inner housing permits in-process vibration and impact testing to ensure that components function properly before the outer housing hermetically seals the device.

Both housings enclose a piezo-electric crystal and a ceramic substrate disc that contains all the electronic components in chip form bonded to the substrate.

OBJECTS OF THE INVENTION

It is an object of the present invention to provide a fuze triggering device which does not rely on rare components.

Another object of the invention is to provide a packaging design which would allow easy removal of the fuze triggering device from the fuze well without damaging the device.

Yet another object of the invention is to provide a means for inspecting, testing, and repairing components of the fuze triggering device.

These and other objects, features and advantages of the invention will become more apparent from the following description when taken in conjunction with the accompanying drawing.

DESCRIPTION OF THE PREFERRED EMBODIMENT

Figure 1:
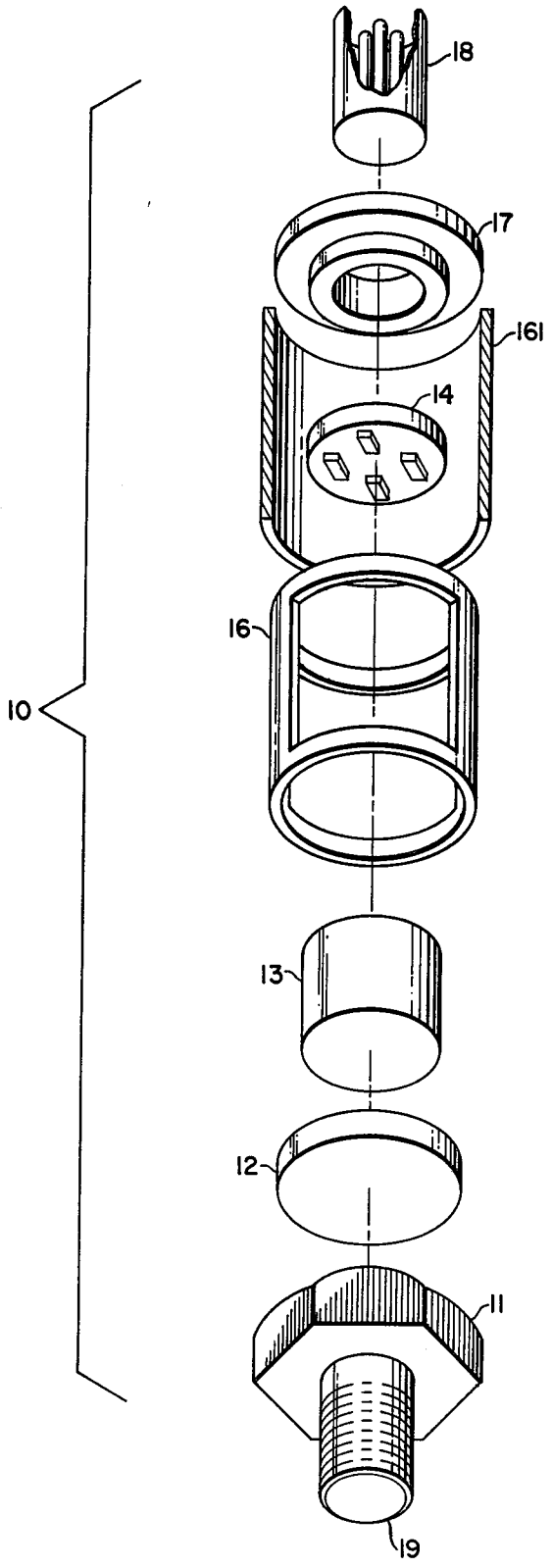
FIG. 1 is an exploded view of the invention taken along the longitudinal axis.

FIG. 1 illustrates the packaging design for a Fuze Triggering Device (FTD) 10 to be used in a typical missile system. FTD 10 is connected to detonators in the safe and arm circuit in the fuze and will not allow a signal to pass to said detonator unless a piezo-electric transducer 13 receives a shock of from 250 g's to 5000 g's.

Referring to FIG. 1, a base 11 is a six-sided platform similar to the common hex nut. Protruding from the underside of base 11 is a threaded stud 19 which is used to attach FTD 10 in the fuze well of the missile. Base 11 and stud 19 facilitate the removal of FTD 10 from the well without undue risk of damage to FTD 10.

Affixed to the upper surface of base 11 is an insulating disc 12 providing electrical separation between base 11 and piezo-electric transducer 13 which is mounted on insulating disc 12. An apertured inner housing 16, an apertured hollow cylinder, fits over and encloses transducer 13 and insulating disc 12. The apertures in inner housing 16 permit complete visual inspection of transducer 13 and a predetermined electrical circuit 15 which is bonded to a single wafer 14 which fits into the upper end of inner housing 16. Wafer 14 is a single ceramic substrate disc.

An apertured cover 17 is attached over inner housing 16. A power supply connector 18 is affixed to cover 17 and electrically connected to circuit 15 via the aperture in cover 17. Circuit 15 is electrically connected to transducer 13 as is more clearly shown in FIG. 2. An outer housing 161, a hollow cylinder, fits over inner housing 16 and is hermetically attached to base 11 and cover 17.

Figure 2:
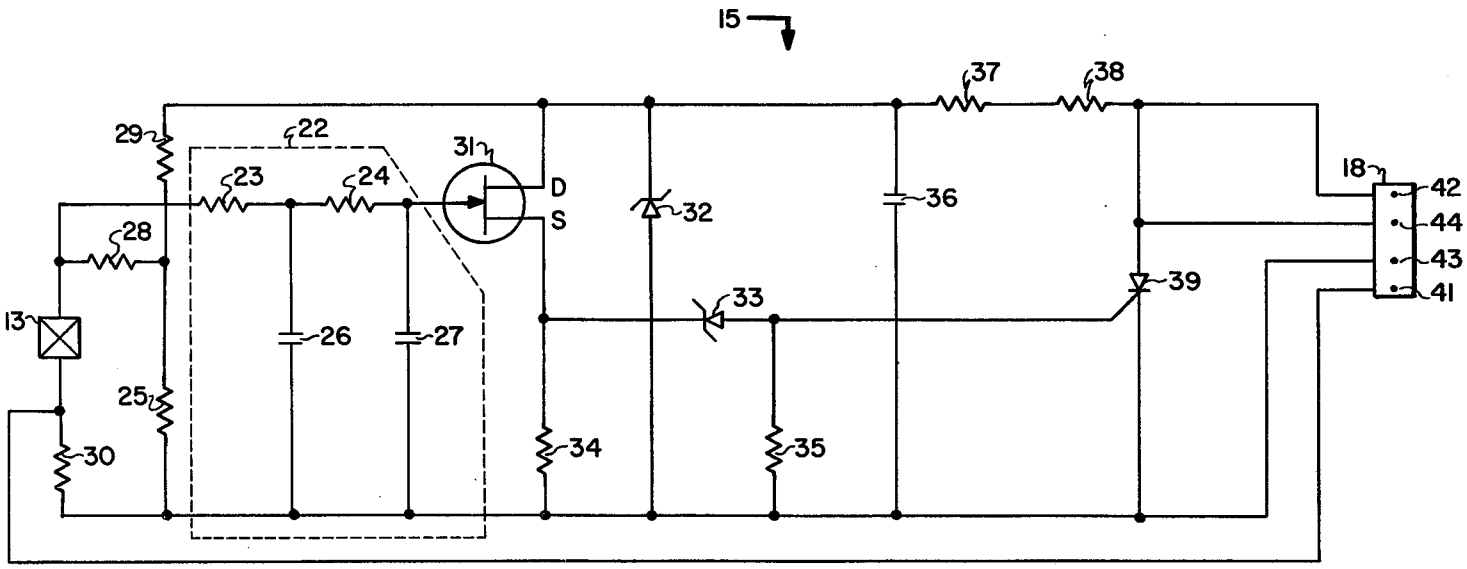
FIG. 2 is a schematic of the triggering circuit of the invention.

Referring to FIG. 2, circuit 15 uses a two pole bandpass filter to filter out unwanted signals from outside sources such as normal missile flight dynamics or premature rocket motor burn out. A first high pass resistor 23 and a first high pass capacitor 26 form the first pole of R. C. filter 22 and a second high pass resistor 24 and a second high pass capacitor 27 form the second pole. Filter 22 delineates the first side of the bandpass while a low pass resistor 28 and the capacitance in transducer 13 form the other side.

Filter 22 and low pass resistor 28 are electrically connected to the positive side of transducer 13. The negative side of transducer 13 is connected to a common line 43 through a test resistor 30. Filter 22 is also tied to common line 43 in the standard manner. Low pass resistor 28 is electrically connected to a point between voltage dividing resistor 25 and 29.

Resistors 25 and 29 normally supply a regulated voltage level to a Field Effect Transistor (FET) 31 via resistor 28 and filter 22 which is connected to the gate terminal of of FET 31. Resistors 25 and 29 receive this voltage via voltage dropping resistors 37 and 38 serially connected along power supply line 42.

The drain terminal of FET 31 is connected to a point between resistors 29 and 37. The source terminal of FET 31 is connected to common line 43 via a source follower resistor 34. A zener diode 32 and a filter capacitor 36 are paralleled between common line 43 and the drain terminal of FET 31.

A second zener diode 33 has its cathode electrically connected to the source terminal of FET 31. A signal developing resistor 35 is connected to the anode of zener diode 33 and to common line 43. The signal developed across resistor 35 is input to the gate of a silicon controlled rectifier (SCR) 39 which is connected to the anode of zener diode 33. SCR 39 has its anode connected to power supply line 42 and its cathode connected to common line 43, with an output line 44 connected to the anode of SCR 39 to provide a signal path to the associated detonator circuitry.

A test line 41 runs from connector 18 to the negative side of transducer 13.

In operation, upon "g" loading of between 250 and 5000 g's at impact, an electrical pulse is output by transducer 13 and is coupled with the DC voltage level maintained by resistors 25 and 29. The combined voltage is applied to the gate terminal of FET 31 which is a high impedance device used in this embodiment to prevent loading of transducer 13. As a sufficient voltage level is applied to the gate of FET 31, FET 31 allows the voltage developed across source follower resistor 34 to rise from a low level to a level of about 8.1 volts.

The application of this 8.1 volt potential to zener diode 33 causes it to conduct and develop a voltage across signal developing resistor 35. This voltage applied at the gate of SCR 39 allows it to conduct and send a signal to the detonator.

For test purposes FTD 10 can be readily removed using base 11 to unthread stud 19 from the fuze well. An AC signal of predetermined frequency is applied to transducer 13 via test line 41. The predetermined frequency is similar to that sent when transducer 13 receives a "g" loading shock. The electronics are thus "fooled" by the applied signal and react accordingly.

If necessary, outer housing 161 can be removed without damaging the component parts. Inner housing 16 then provides access to transducer 13 and circuit 15 for inspection and/or repairs as needed. Outer housing 161 can be resealed and FTD 10 returned to the fuze well.

It is to be understood that the description and figures presented herein represent a particular embodiment of the invention for illustrative purposes only and that a number of modifications and adaptations may be suggested for other embodiments and uses without departing from the scope and principles of the invention which are set out in the appended claims.

I claim:

1. A fuze triggering device, for fuze detonated weapons, comprising:

a base;

means for mounting said device attached to said base;

means for insulating the upper surface of said base attached thereto;

means for generating an electrical signal from "g" loading, mounted on said insulating means;

an electronics wafer, having a preprinted circuit therein, electrically connected to said signal generating means;

means for enclosing said insulating means, said generating means and said wafer, hermetically sealed to said base;

an apertured cover for said enclosing means, hermetically sealed thereto; and means for connecting extended electric leads to said wafer through said apertured cover, hermetically sealed to said cover.

2. A fuze triggering device according to claim 1 wherein said base is a standard fastening nut.

3. A fuze triggering device according to claim 1 wherein said mounting means is a threaded stud attached to and protruding axially from said base.

4. A fuze triggering device according to claim 1 wherein said insulating means is a disc of insulating material of sufficient size and thickness to electrically insulate said base from said generating means.

5. A fuze triggering device according to claim 1 wherein said generating means is a piezo-electric transducer.

6. A fuze triggering device according to claim 5 wherein said circuit comprises:

a band pass filter connected to filter an input from said transducer;

a field effect transistor gated by the output of said filter;

a zener diode with its cathode connected to said field effect transistor source terminal receiving its input therefrom;

and a silicon controlled rectifier gated by the output of said zener diode and outputting a triggering signal.

7. A fuze triggering device according to claim 6 wherein said circuit further comprises a test line providing input to said transducer for emulating "g" loading effects.

8. A fuze triggering device according to claim 5 wherein said circuit comprises:

a power supply line connected to said connecting means;

a common line connected to said connecting means;

a circuit test resistor connected between the negative terminal of said transducer and said common line;

a low pass resistor connected to the positive terminal of said transducer;

a first voltage divider resistor connected between said low pass resistor and said common line;

a second voltage divider resistor connected to a point between said low pass resistor and said first voltage dividing resistor;

a first voltage dropping resistor connected serially with said second voltage dividing resistor;

a second voltage dropping resistor connected serially between said power supply line and said first voltage dropping resistor;

a resistor-capacitor filter operably connected to filter the output of said transducer;

a field effect transistor having its gate connected to the output of said filter, and its drain terminal connected to a point between said second voltage divider resistor and said first voltage dropping resistor;

a zener diode having its cathode connected to said drain terminal and its anode connected to said common line;

a filter capacitor connected parallel to said zener diode;

a source follower resistor connected between the source terminal of said field effect transistor and said common line;

a second zener diode having its cathode connected to said source terminal;

a signal developing resistor connected between the anode of said second zener diode and said common line;

a silicon controlled rectifier having its gate connected to said second zener diode's anode, its cathode to said common line, and its anode connected to said power supply line;

an output line connected to said silicon controlled rectifier anode; and a test line connected between said transducer negative terminal and said connecting means.

9. A fuze triggering device according to claim 8 wherein said filter comprises:

a first high pass resistor, connected to a point between said transducer and said low pass resistor;

a first high pass capacitor connected between said first high pass resistor and said common line;

a second high pass resistor connected between said first high pass resistor and said field effect transistor gate terminal;

and a second high pass capacitor connected between said field effect transistor's gate terminal and said common line.

10. A fuze triggering device according to claim 9 wherein said electrical circuit is mounted on a single ceramic substrate disc.

11. A fuze triggering device according to claim 5 wherein said enclosing means comprises:

a hollow cylindrical inner housing, having an apertured wall through which said transducer and said electronic's wafer may be examined, tested and repaired, fixedly attached to said base; and a hollow cylindrical outer housing enclosing said inner housing, hermetically sealed to said base and said apertured cover.

12. A fuze triggering device according to claim 8 wherein said connecting means is a four terminal plug having a terminal for said power supply line, said common line, said test line and said silicon controlled rectifier output line.

* * * * *